US005680932A

United States Patent [19]

Dickinson et al.

[11] Patent Number: 5,680,932

[45] Date of Patent: Oct. 28, 1997

[54] TOOLBOX ASSEMBLY

[75] Inventors: Thomas Dickinson; Bradley D. Gale, both of St. Louis, Mo.

[73] Assignee: Contico International, Inc., St. Louis, Mo.

[21] Appl. No.: 572,784

[22] Filed: Dec. 15, 1995

[51] Int. Cl.[6] ..... B65D 21/02

[52] U.S. Cl. ..... 206/372; 206/514; 206/338; 220/523; 220/527; 220/771; 312/902

[58] Field of Search ..... 206/315.11, 372, 206/373, 523, 338, 514; 220/23.83, 23.86, 408, 410, 527, 528, 771, 776; 312/902

[56] References Cited

U.S. PATENT DOCUMENTS

| | | | |
|---|---|---|---|
| 1,614,910 | 1/1927 | Yarder | 220/528 |
| 1,984,345 | 12/1934 | Kennedy | 206/373 |
| 4,714,158 | 12/1987 | Oltman et al. | 206/372 |
| 5,079,863 | 1/1992 | Gillespie | 206/315.11 |
| 5,117,979 | 6/1992 | Brightbill . | |
| 5,297,674 | 3/1994 | Birutis et al. | 220/528 |
| 5,337,892 | 8/1994 | Zaffina | 206/315.11 |
| 5,386,922 | 2/1995 | Jordan | 206/373 |

*Primary Examiner*—Jimmy G. Foster
*Attorney, Agent, or Firm*—Howell & Haferkamp, L.C.

[57] ABSTRACT

A toolbox assembly comprising a storage box, a tool tray, and a toolbox. The tool tray has a tray floor and a plurality of tray walls extending up from the tray floor. The tray walls and tray floor define first and second separate storage compartment regions for storage of articles placed therein. The tray walls further define a storage box receiving chamber above the first storage compartment region. The tray is configured for supporting the storage box within the storage box receiving chamber and spaced above the tray floor. The storage box is sized and configured for covering the first storage compartment region when the storage box is received in the storage box receiving chamber. The toolbox has a toolbox floor and a plurality of toolbox sidewalls extending up from the toolbox floor and defining a tray receiving chamber. The toolbox is shaped and configured for supporting the tray within the tray receiving chamber and spaced above the toolbox floor.

17 Claims, 5 Drawing Sheets

TOOLBOX ASSEMBLY

BACKGROUND OF THE INVENTION

This invention relates to toolboxes and more particularly to toolboxes having removable tool trays.

A typical toolbox has four sidewalls, a floor, and a lid. A ledge (or other support) extends inwardly from inside surfaces of the sidewalls for supporting a tool tray. The tool tray is generally rectangular in shape and includes a handle for facilitating a user in lifting the tool tray out of or lowering the tray into the toolbox. The tool tray usually has compartments for storage of small tools, fasteners (e.g., screws, bolts, nuts, etc.) and/or other articles. The ledge of the toolbox supports the tool tray above the floor so that larger tools can be placed in the space under the tray.

A disadvantage associated with such a tool tray is that small articles (e.g., fasteners) placed within the compartments of the tool tray might fall out of the compartments as the toolbox is carried between work sites, tipped, or otherwise jostled. If the articles fall out of such compartments, they might undesirable mix with articles in other compartments of the tool tray or fall into the large tool storage space.

Another disadvantage associated with such tool trays concerns the number and sizes of compartments in the tool tray. Most tool trays have some relatively large compartments for holding tools and/or large fasteners (e.g., long screws and bolts) and some smaller compartments for holding smaller fasteners and other hardware. If a tool tray has a few large compartments, then it might not have a sufficiently high number of small compartments to separately holds the user's smaller articles. If a tool tray has only small compartments, then the tray cannot hold large articles.

SUMMARY OF THE INVENTION

Among the several objects of the present invention may be noted the provision of an improved toolbox; the provision of such a toolbox which overcomes the above-mentioned disadvantages associated with conventional toolboxes; the provision of such a toolbox configured for preventing small articles placed within compartments therein from falling out of such compartments when the toolbox is moved, tilted, or otherwise jostled; the provision of such a toolbox capable of holding large fasteners without minimizing the number of small compartments; and the provision of such a toolbox which is convenient to use and which is of relatively simple and inexpensive construction.

In General, a toolbox assembly of the present invention comprises a storage box, a tool tray, and a toolbox. The tool tray has a tray floor and a plurality of tray walls extending up from the tray floor. The tray walls and tray floor define first and second separate storage compartment regions for storage of articles placed therein. The tray walls further define a storage box receiving chamber above the first storage compartment region. The tray is configured for supporting the storage box within the storage box receiving chamber and spaced above the tray floor. The storage box is sized and configured for covering the first storage compartment region when the storage box is received in the storage box receiving chamber. The toolbox has a toolbox floor and a plurality of toolbox sidewalls extending up from the toolbox floor and defining a tray receiving chamber. The toolbox is shaped and configured for supporting the tray within the tray receiving chamber and spaced above the toolbox floor.

In another aspect of the present invention a tool tray assembly comprises a storage box and a tool tray. The tool tray has a tray floor and a plurality of tray walls extending up from the tray floor. The tray walls and tray floor define first and second separate storage compartment regions for storage of articles placed therein. The tray walls further define a storage box receiving chamber above the first storage compartment region. The tray is configured for supporting the storage box within the storage box receiving chamber and spaced above the tray floor. The storage box is sized and configured for covering the first storage compartment region when the storage box is received in the storage box receiving chamber.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
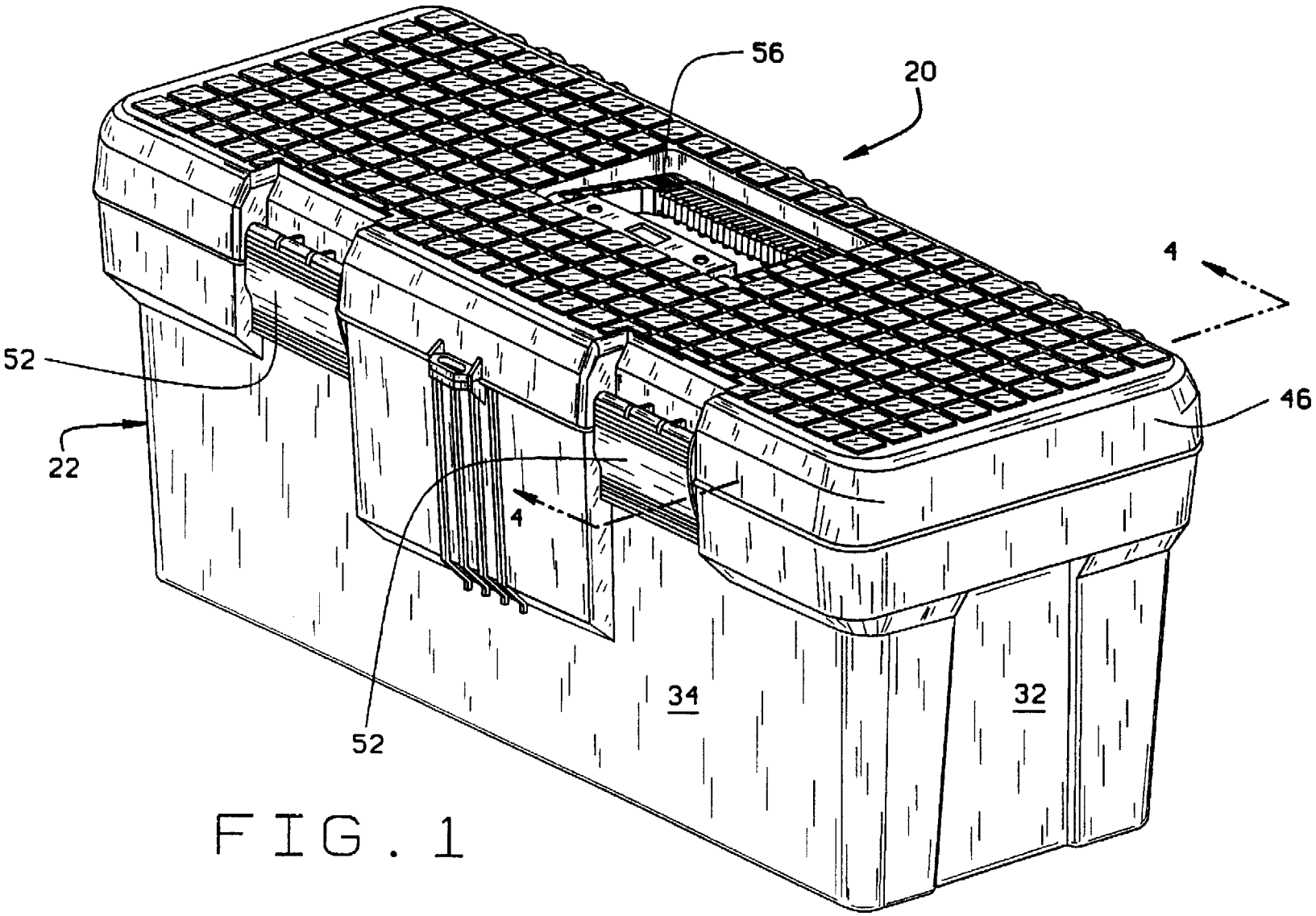
FIG. 1 is a perspective view of a toolbox assembly of the present invention showing a toolbox and a lid closing the top of the toolbox.
Figure 2:
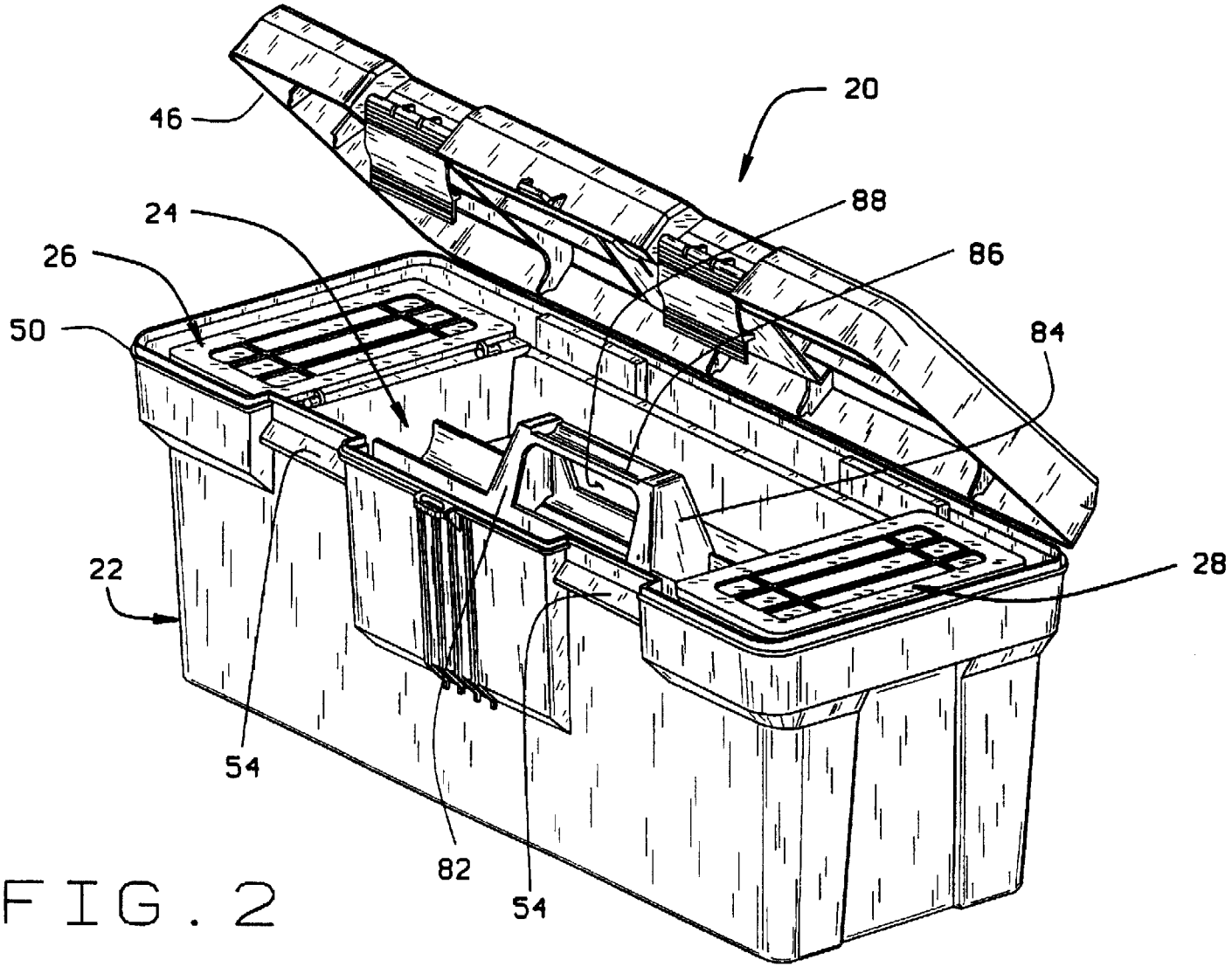
FIG. 2 is a perspective view of the toolbox assembly of FIG. 1 with the lid pivoted upward to reveal a tool tray and two storage boxes of the toolbox assembly.
Figure 3:
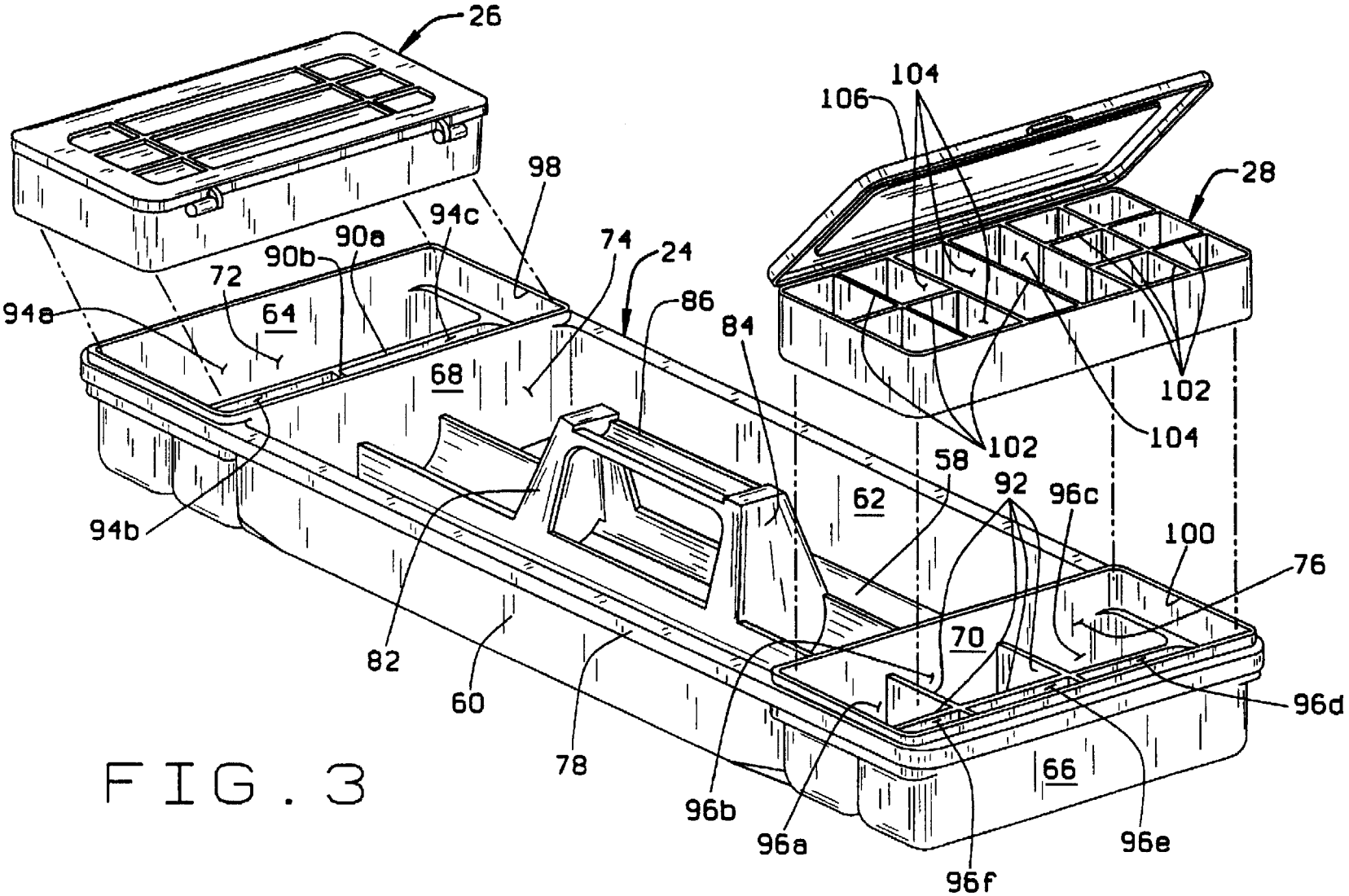
FIG. 3 is an enlarged, exploded perspective view of the tool tray and storage boxes removed from the toolbox.

Referring now to the drawings, and first more particularly to FIGS. 1–3, a toolbox assembly of the present invention is indicated in its entirety by the reference numeral 20. The toolbox assembly comprises a toolbox, generally indicated at 22, a tool tray, Generally indicated at 24, and first and second storage boxes 26, 28.

The toolbox 22 has a toolbox floor 30 (FIGS. 4 and 5) and four sidewalls (i.e., two end walls 32, a back wall 33, and a front wall 34) extending up from the toolbox floor. The walls 32, 33, 34 define a tray receiving chamber 36 and the upper end of the toolbox 22 is open for receiving the tool tray 24 in the tray receiving chamber 36. Four ribs 38 extend upward from the toolbox floor 30 on inner surfaces 40, 41 (FIG. 4) of the back and front walls 33, 34 (two ribs on each wall). Inner surfaces 42 (FIG. 5) of the end walls 32 are formed with upstanding protrusions 44. As discussed in greater detail below, upper ends of the ribs 38 and upstanding protrusions 44 engage and support the tool tray 24 when the tool tray is inserted into the tray receiving chamber 36 via the open top of the toolbox 22. The upper ends of the ribs 38 and the upstanding protrusions 44 maintain the tool tray 24 spaced above the toolbox floor 30.

A toolbox lid 46 is pivotally connected to the back wall 32 of the toolbox 22 via hinges 48 (FIG. 4) for allowing the lid to be pivoted relative to the toolbox between a closed position (FIG. 1) in which it covers the open top of the toolbox and an open position (e.g., FIG. 2) in which the lid is swung away from the open top to permit access into the tray receiving chamber 36 of the toolbox. A flange 50 extends outwardly from outer surfaces of the toolbox walls 32, 33, 34 and adjacent upper edges of the walls. The lid 46 is sized and configured so that when it is in its closed position, the periphery of the lid is engaged and supported by the flange. Preferably, the lid 46 includes latches 52 engageable with downwardly turned catches 54 on the outer surface of the front wall 34 of the toolbox 22 for releasably latching (locking) the lid to the toolbox when the lid is closed. The lid 46 also includes a handle 56 for facilitating carrying of the toolbox 22.

The tool tray 24 is a substantially rectangular container. It has a tray floor 58, parallel front and back walls 60, 62 extending up from the tray floor, first and second parallel end walls 64, 66 extending up from the tray floor and traversing ends of the front and back walls, and first and second divider walls 68, 70 extending up from the tray floor. The divider walls 68, 70 are spaced between the tray end walls 64, 66 and generally parallel therewith. The tray walls 60, 62, 64, 66 and tray floor 58 define first, second and third separate storage compartment regions 72, 74, 76 for storage of articles placed therein. A downwardly-turned flange 78 at the periphery of the tool tray 24 engages the upstanding protrusions 44 of the toolbox 22 when the tool tray is inserted in the tray receiving chamber 36. Also, the underside of the tray floor 58 engages the upper ends of the ribs 38 of the toolbox 22 when the tool tray 24 is inserted in the tray receiving chamber 36.

The second storage compartment region 74 is generally between the first and third storage compartment regions 72, 76. The second storage compartment region 74 is sized and configured for storage of small tools (e.g., screw drivers, pliers, etc). A handle 80 extends up from the tray floor 58 in the second storage compartment region 74. The handle 80 has first and second spaced apart supportive end portions 82, 84, a gripping portion 86 extending between the end portions, and a hand opening 88 below the gripping portion and between the end portions. A user may grasp the gripping portion of the tray handle 80 and thereby lift the tool tray 24 out of the toolbox 22 or insert the tool tray into the toolbox.

A plurality of vertical partition walls extend up from the tray floor 58 within the first and third storage compartment regions 72, 76 for separating each of these regions into a plurality of sub-compartments. In particular, a first plurality of partition walls 90*a*, 90*b* extend upward from the tray floor 58 within the first storage compartment region 72, and a second plurality of partition walls 92 extend upward from the tray floor within the third storage compartment region 76. Preferably, the first plurality of partition walls 90*a*, 90*b* includes a long partition wall 90*a* and a short partition wall 90*b*. The long partition wall 90*a* extends between the front and back walls 60, 62 of the tool tray 24 and is spaced substantially equidistant from the first divider wall 68 and the first end wall 64. The short partition wall 90*b* extends between the long partition wall 90*a* and first divider wall 68 and is spaced substantially equidistant from the front and back walls 60, 62 of the tool tray 24. Thus, the first plurality of partition walls 90*a*, 90*b* divide the first storage compartment region into three sub-compartments 94*a–c*, one of which is twice as large as the other two. Preferably, the second plurality of partition walls 92 divide the third storage compartment region 76 into six sub-compartments 96*a–f* which are substantially equal in size. Because the sub-compartments 94*a–c*, 96*a–f* of the first and third storage compartment regions 72, 76 are of different sizes, they can hold fasteners or small articles of various sizes. For example, longer screws, bolts, etc., can be placed in the sub-compartments 94*a–c* of the first storage compartment region 72 and nuts, washers, shorter screws, etc., can be placed in the sub-compartments 96*a–f* of the third storage compartment region 76.

Figure 4:
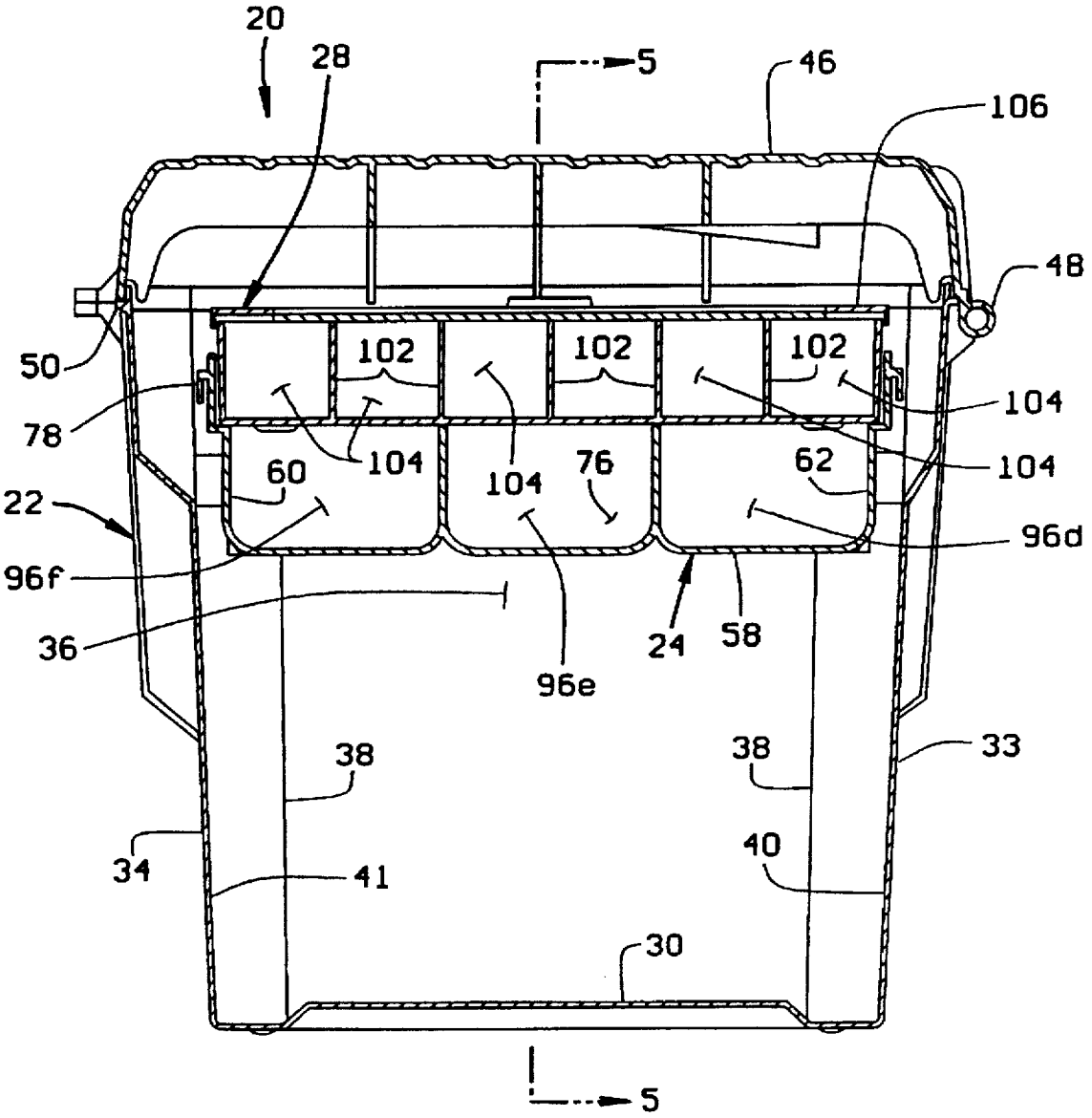
FIG. 4 is a cross-sectional view taken along the plane of line 4—4 of FIG. 1.
Figure 5:
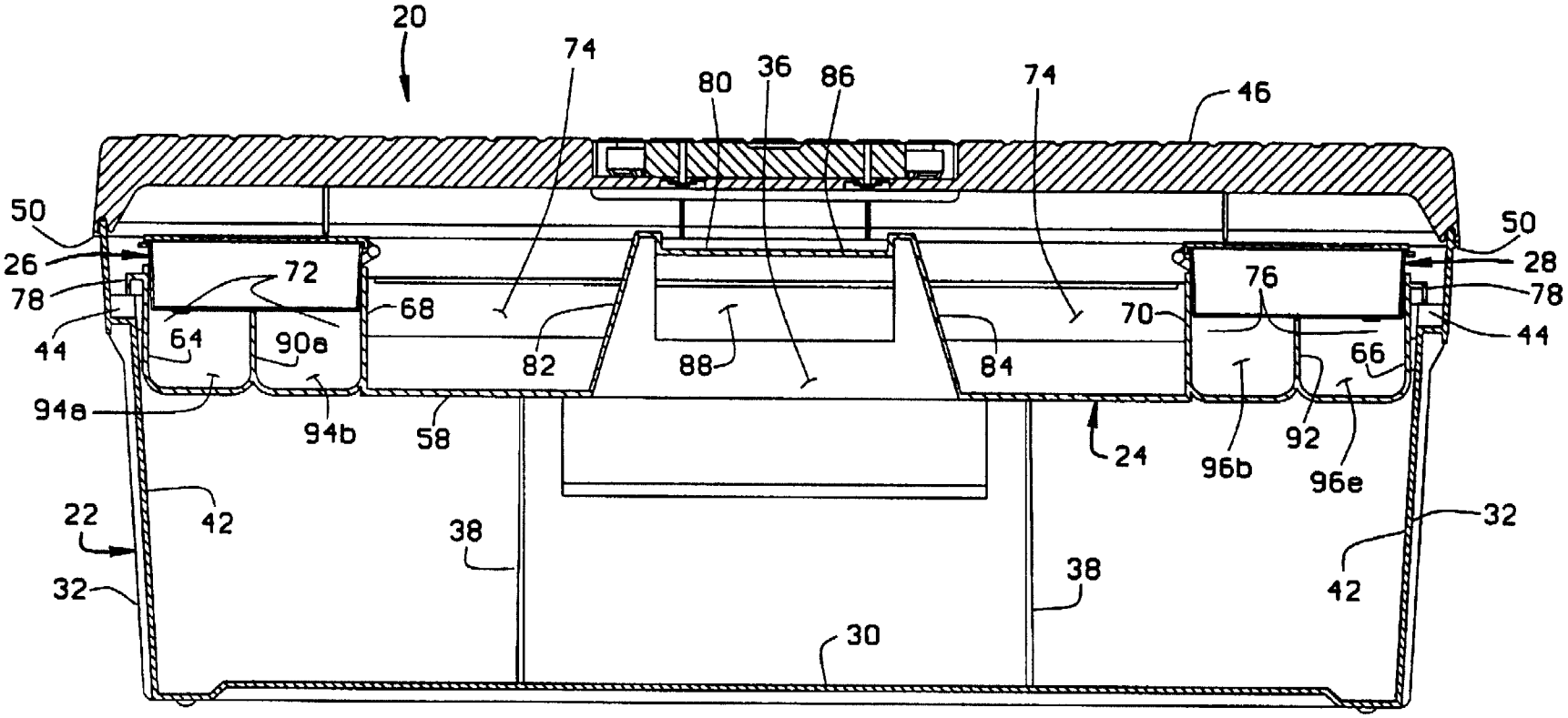
FIG. 5 is a cross-sectional view taken along the plane of line 5—5 of FIG. 4.

Referring to FIGS. 3–5, the tray front wall 60, back wall 62, end walls 64, 66, and divider walls 68, 70 extend up above the partition walls 90*a–b*, 92 to define storage box receiving chambers. In particular, the first end wall 64, the first divider wall 68, the front wall 60, and the back wall 62 define a first storage box receiving chamber 98 (FIG. 3) above the sub-compartments 94*a–c* of the first storage compartment region 72 for nestably receiving the first storage box 26. The second end wall 66, the second divider wall 70, the front wall 60, and the back wall 62 define a second storage box receiving chamber 100 (FIG. 3) above the sub-compartments 96*a–f* of the third storage compartment region 76 for nestably receiving the second storage box 28.

Preferably, the first and second storage boxes 26, 28 are identical. Thus, only the second storage box will be described in detail. However, it is to be understood that the description thereof is equally applicable to the first storage box. The second storage box 28 is generally rectangular in horizontal cross-section and preferably has vertical divider walls 102 defining a plurality of small article receiving compartments 104 accessible from the top of the second storage box. A lid 106 is hinged to an upper edge of the second storage box 28 for covering the top thereof.

The storage boxes 26, 28 and the portions of the walls of the tool tray 24 which define the first and second box receiving chambers 98, 100 are sized and shaped for a close sliding fit of the storage boxes in the box receiving chambers. The first and second box receiving chambers 98, 100 are preferably of the same size and shape so that either storage box 26, 28 can be inserted into either box receiving chamber. Also, upper edges of the tray partition walls 90*a*, 90*b* of the first plurality of partition walls are substantially coplanar with one another so that the underside of the first storage box 26 engages the upper partition edges all around the sub-compartments 94*a–c* when the first storage box is received in the first storage box receiving chamber 98. Likewise, upper edges of the tray partition walls 92 of the second plurality of partition walls are substantially coplanar with one another so that the underside of the second storage box 28 engages these upper partition edges all around the sub-compartments 96*a–f* of the third storage compartment region 76 when the second storage box is received in the second storage box receiving chamber 100. Because of the engagement of the storage boxes 26, 28 with the upper partition edges, the storage boxes cover (or seal) the sub-compartments 94*a–c*, 96*a–f* when the storage boxes are received in the storage box receiving chambers 98, 100 to prevent articles placed in the sub-compartments from falling out of the sub-compartments.

In use, a user places small articles (e.g., screws, bolts, nuts, etc.) in the sub-compartments 94*a–c*, 96*a–f* of the tool tray 24 and in the compartments 104 of the storage boxes 26, 28. The user then closes the lids 106 of the storage boxes 26, 28 and then inserts the storage boxes in the storage box receiving chambers 98, 100 of the tool tray 24. The user may place relatively large tools in the toolbox 22 and then insert the tool tray 24 in the tray receiving chamber 36. Smaller tools, such as screw drivers, pliers, etc., may be placed in the second storage compartment region 74 of the tool tray 24. The toolbox lid 46 is then moved to its closed position and then latched to the toolbox 22. When the storage boxes 26, 28, tool tray 24, and toolbox lid 46 are positioned in this manner, the underside of the toolbox lid is preferably closely adjacent the closed lids 106 of the storage boxes to maintain the lids of the storage boxes closed and to maintain the storage boxes in the storage box receiving chambers 98, 100. Thus, if the toolbox 22 is turned upside down, the lids 106 of the storage boxes will not open and the storage boxes 26, 28 will not slide out of the storage box receiving chambers 98, 100. Also, because of the close fit of the first and second storage boxes 26, 28 in the first and second storage box receiving chambers 98, 100, and because the upper edges of the partition walls 90*a*, 90*b*, 92 engage the undersides of the storage boxes, articles placed within the sub-compartments 94*a–c*, 96*a–f* of the first and third storage compartment regions 72, 76 will not fall out of their respective sub-compartments even when the toolbox 22 is turned upside down. Because small articles can be placed in the sub-compartments of the tool tray 24 and in the compartments of the storage boxes 26, 28, the toolbox assembly 20 can hold relatively large fasteners without minimizing the number of small compartments. Thus, the toolbox assembly 20 of the present invention is convenient and simple to use.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. A toolbox assembly comprising:

a storage box;

a tool tray having a tray floor and a plurality of tray walls extending up from the tray floor, the tray walls and tray floor defining first and second separate storage compartment regions for storage of articles placed therein, the tray further including at least one partition within the first storage compartment region and extending up from the tray floor, said at least one partition separating the first storage compartment region into a plurality of sub-compartment regions, said at least one partition having at least one upper partition edge, at least one of the tray walls which defines the first storage compartment region including a ledge, the upper partition edge and the ledge being generally coplanar, the tray walls further defining a storage box receiving chamber above the first storage compartment region, the tray being configured for supporting the storage box within the storage box receiving chamber and spaced above the tray floor, the storage box being sized and configured for covering the first storage compartment region when the storage box is received in the storage box receiving chamber, the tool tray and storage box further being configured such that the storage box engages said at least one upper partition edge and said ledge when the storage box is received in the storage box receiving compartment to close each sub-compartment and thereby prevent articles placed in the sub-compartments from falling out of the sub-compartments; and a toolbox having a toolbox floor and a plurality of toolbox sidewalls extending up from the toolbox floor and defining a tray receiving chamber, said toolbox being shaped and configured for supporting the tray within the tray receiving chamber and spaced above the toolbox floor.

2. A toolbox as set forth in claim 1 wherein the toolbox further comprises a toolbox lid hinged to one of the toolbox sidewalls for movement between open and closed positions, the toolbox being shaped and configured (a) for providing access into the tray receiving chamber to facilitate insertion of the tool tray into and removal of the tool tray from the tray receiving chamber when the lid is in its open position, and (b) so that the lid substantially covers the tray receiving chamber when the lid is in its closed position.

3. A toolbox assembly as set forth in claim 1 wherein said at least one partition comprises at least two partitions within the first storage compartment region and extending up from the tray floor, the partitions separating the first storage compartment region into said plurality of sub-compartment regions.

4. A toolbox assembly as set forth in claim 3 wherein said at least two partitions have upper partition edges, said upper partition edges constituting said at least one upper partition edge and being generally coplanar with one another.

5. A toolbox assembly as set forth in claim 4 wherein the tool tray and storage box are configured such that the storage box engages each of the upper partition edges when the storage box is received in the storage box receiving compartment to close each sub-compartment and thereby prevent articles placed in the sub-compartments from falling out of the sub-compartments.

6. A toolbox assembly as set forth in claim 5 wherein the storage box includes a lid.

7. A toolbox as set forth in claim 6 wherein the toolbox further comprises a toolbox lid hinged to one of the toolbox sidewalls for movement between open and closed positions, and at least one latch for securing the toolbox lid to the toolbox, the toolbox, tool tray, and storage box being configured so that when the toolbox lid is latched to the toolbox, it maintains the storage box in engagement with the upper partition edges of the tool tray and maintains the lid of the storage box in a closed position, even if the toolbox assembly is inverted.

8. A toolbox assembly as set forth in claim 1 wherein the tray floor and tray walls of the tool tray further define a third storage compartment region, said second storage compartment region being generally between said first storage compartment region and said third storage compartment region.

9. A toolbox assembly as set forth in claim 8 further comprising another storage box, said tray walls further defining another storage box receiving chamber above the third storage compartment region, the tool tray being configured for supporting said another storage box within said another storage box receiving chamber and spaced above the tray floor, said another storage box being sized and configured for covering the third storage compartment region when said another storage box is received in said another storage box receiving chamber.

10. A toolbox assembly as set forth in claim 8 wherein the third storage compartment region is substantially the same size as the first storage compartment region.

11. A toolbox assembly as set forth in claim 8 wherein said storage tray further comprises a handle extending up from the second storage compartment region, the handle having first and second spaced apart supportive end portions, a gripping portion extending between the end portions, and a hand opening below the gripping portion and between the end portions.

12. A toolbox assembly comprising:

a storage box;

a tool tray having a tray floor, a plurality of tray walls extending up from the tray floor, and a tool tray handle configured to be grasped by a user to facilitate lifting of the tool tray by the user, the tray walls and tray floor defining first and second separate storage compartment regions for storage of articles placed therein, the tray further including at least one partition within the first storage compartment region and extending up from the tray floor, the partition separating the first storage compartment region into a plurality of sub-compartment regions, the partition having an upper partition edge, the tray walls further defining a storage box receiving chamber above the first storage compartment region the tray being configured for supporting the storage box within the first storage box receiving chamber and spaced above the tray floor, the storage box being sized and configured for covering the first storage compartment region when the storage box is received in the first storage box receiving chamber, the tool tray and storage box further being configured such that the storage box engages the upper partition edge when the storage box is received in the storage box receiving chamber to close each sub-compartment and thereby prevent articles placed in the sub-compartments from falling out of the sub-compartments;

a toolbox having a toolbox floor and a plurality of toolbox sidewalls extending up from the toolbox floor and defining a tray receiving chamber, said toolbox being shaped and configured for supporting the tray within the tray receiving chamber and spaced above the toolbox floor;

a toolbox lid hinged to one of the toolbox sidewalls for movement between open and closed positions; and at least one latch for securing the toolbox lid to the toolbox;

the toolbox, tool tray, and storage box being configured so that when the toolbox lid is latched to the toolbox, it maintains the storage box in engagement with the upper partition edge of the tool tray, even when the toolbox assembly is inverted.

13. A toolbox assembly as set forth in claim 12 wherein:

the storage box constitutes a first storage box;

the toolbox assembly further includes a second storage box; and the tray walls and tray floor further define a third storage compartment region, said second storage compartment region being generally between the first and third storage compartment regions, the storage box receiving chamber constituting a first storage box receiving chamber, the tray walls further defining a second storage box receiving chamber above the third storage compartment region, the tray being configured for supporting the second storage box within the second storage box receiving chamber and spaced above the tray floor, the second storage box being sized and configured for covering the third storage compartment region when the storage box is received in the second storage box receiving chamber.

14. A toolbox assembly comprising:

a storage box including a lid;

a tool tray having a tray floor and a plurality of tray walls extending up from the tray floor, the tray walls and tray floor defining first and second separate storage compartment regions for storage of articles placed therein, the tray further including at least one partition within the first storage compartment region and extending up from the tray floor, said at least one partition separating the first storage compartment region into a plurality of sub-compartment regions, said at least one partition having at least one upper partition edge, the tray walls further defining a storage box receiving chamber above the first storage compartment region, the tray being configured for supporting the storage box within the storage box receiving chamber and spaced above the tray floor, the storage box being sized and configured for covering the first storage compartment region when the storage box is received in the storage box receiving chamber, the tool tray and storage box further being configured such that the storage box engages said at least one upper partition edge when the storage box is received in the storage box receiving compartment to close each sub-compartment and thereby prevent articles placed in the sub-compartments from falling out of the sub-compartments;

a toolbox having a toolbox floor and a plurality of toolbox sidewalls extending up from the toolbox floor and defining a tray receiving chamber, said toolbox being shaped and configured for supporting the tray within the tray receiving chamber and spaced above the toolbox floor;

a toolbox lid hinged to one of the toolbox sidewalls for movement between open and closed positions; and at least one latch for securing the toolbox lid to the toolbox;

the toolbox, tool tray, and storage box being configured so that when the toolbox lid is latched to the toolbox, it maintains the storage box in engagement with the upper partition edges of the tool tray while maintaining the lid of the storage box in a closed position, even if the toolbox assembly is inverted.

15. A toolbox assembly as set forth in claim 14 wherein said at least one partition comprises at least two partitions within the first storage compartment region and extending up from the tray floor, the partitions separating the first storage compartment region into a said plurality of sub-compartment regions.

16. A toolbox assembly as set forth in claim 15 wherein said at least two partitions have upper partition edges, said upper partition edges constituting said at least one upper partition edge and being generally coplanar with one another.

17. A toolbox assembly as set forth in claim 16 wherein the tool tray and storage box are configured such that the storage box engages each of the upper partition edges when the storage box is received in the storage box receiving compartment to close each sub-compartment and thereby prevent articles placed in the sub-compartments from falling out of the sub-compartments.

* * * * *